United States Patent [19]

Doudet

[11] 4,326,399

[45] Apr. 27, 1982

[54] EXTRUSION PRESS OPERATING BY THE INDIRECT METHOD

[75] Inventor: Michel Doudet, Epone, France

[73] Assignee: SECIM, Courbevoie, France

[21] Appl. No.: 886,771

[22] Filed: Mar. 14, 1978

[51] Int. Cl.[3] ..... B21C 33/00; B21C 35/00; B21C 35/04

[52] U.S. Cl. ..... 72/263; 72/264; 72/255; 72/270; 72/273.5

[58] Field of Search ..... 72/263–265, 72/253, 255, 270, 273.5

[56] References Cited

U.S. PATENT DOCUMENTS

| | | | |
|---|---|---|---|
| 3,528,275 | 9/1970 | Sibler | 72/265 |
| 3,534,578 | 10/1970 | Asari | 72/263 |
| 3,738,144 | 6/1973 | Doudet | 72/263 |

FOREIGN PATENT DOCUMENTS

| | | | |
|---|---|---|---|
| 526475 | 8/1956 | Belgium | 72/273.5 |
| 502426 | 7/1930 | Fed. Rep. of Germany | 72/263 |
| 531962 | 8/1931 | Fed. Rep. of Germany | 72/265 |
| 842039 | 6/1952 | Fed. Rep. of Germany | 72/263 |
| 2732804 | 2/1978 | Fed. Rep. of Germany | 72/265 |
| 2098696 | 3/1972 | France | 72/263 |
| 2098808 | 3/1972 | France | 72/270 |
| 2305249 | 10/1976 | France | 72/263 |
| 2360359 | 3/1978 | France | 72/263 |
| 53-30965 | 3/1978 | Japan | 72/270 |
| 1188972 | 4/1970 | United Kingdom | 72/264 |

*Primary Examiner*—Lowell A. Larson
*Attorney, Agent, or Firm*—Pollock, Vande Sande & Priddy

[57] ABSTRACT

A press operated by the reverse method comprising a fixed tubular die casing defining a pressing axis, a main jack operative to displace a cross beam supported for displacement along the pressing axis, a displaceable holder disposed between the cross beam and the tubular die casing and having a bore disposed along the pressing axis for receiving a billet to be pressed. The bore has open ends and the holder is capable of fitting over the die casing by axial displacement thereof. A closure member is carried by a slide for closing one end of the bore in the holder; the slide is displaceable on the cross beam transversely with respect to the pressing axis. A support is slidably mounted parallel to the slide and is carried by an auxiliary cross beam which is slidably mounted on the main cross beam for movement parallel to the pressing axis. The support and the slide are simultaneously displaceable under the action of a jack or other suitable device. A rod is connected to the support and is slidably mounted axially in the slide for operating auxiliary members slidably mounted in the slide.

3 Claims, 7 Drawing Figures

IV
IV
I
I
2
21
5
9
52
53
50
60
21.2
7
8
80
1
83
82
71
8

EXTRUSION PRESS OPERATING BY THE INDIRECT METHOD

FIELD OF THE INVENTION

The invention relates to a press operating by the reverse method i.e. an indirect extrusion press permitting acceleration and facilitating production, notably for the manufacture of tubes.

PRIOR ART

It is known that extrusion or pressing operations by the indirect or reverse method consist in placing a metal billet in a container which is displaced towards a fixed die casing carrying a die. The reverse presses therefore normally comprise a fixed tubular die casing defining the pressing axis, a main jack for the displacement of a movable cross beam, a container disposed between the die casing and the movable cross beam and provided, along the pressing axis, with a housing for the billet to be pressed, this housing being opened at its extremities and fitting over the die casing by displacement of the movable cross beam, the same bearing against the container through the intermediary of a base which is generally mounted on a slide transversely displaceable with respect to the pressing axis on the movable cross beam.

It is sometimes necessary to place on the pressing axis, according to different stages of operation, a certain number of auxiliary members. Thus, at the completion of pressing, there remains between the base of the container and the die a plug of metal which must be detached from the wire formed by the pressing operation. For this purpose, it is conventional to utilize a cutting device, that is to say, a type of punch placed along the axis of the base of the container and having a diameter slightly less than that of the die. During the pressing operation, the punch is retracted and at the end of the pressing operation it is advanced axially in a manner to pierce the plug up to the die. Thus, the wire is separated from the plug without loss of length. Another auxiliary member is disclosed in French Pat. No. 2,098,696 in which the base of the container is mounted on the slide, the latter carrying a housing for supply of a new billet. During the pressing operations, the base of the container is disposed along the pressing axis and the new billet is placed in the housing. When the movable cross beam is retracted to permit the removal of the plug, the slide carrying the base of the container is displaced transversely in order to bring the new billet into alignment with the pressing axis. It is then possible to displace the new billet into the housing of the container, for example, by means of a jack placed on the movable cross beam along the pressing axis to remove both the plug and a flashing remaining after the pressing along the wall of the housing of the container.

Finally, for the pressing of tubes, there is generally utilized a plunger disposed along the pressing axis and which traverses the billet and extends into the die with a clearance permitting the formation of the tube in the course of the displacement of the container with respect to the die. Up to the present, the formation of tubes is effected by the direct method in which the container and the die are fixed and the die casing is movable. In effect, the utilization of a plunger and notably the control of its position during pressing undoubtedly seems easier in a direct press where only the die casing is movable.

SUMMARY OF THE INVENTION

The invention has as its object improvements permitting, by simple arrangements, the placement along the axis of pressing, according to the stages of production, various auxiliary members and thus to substantially diminish the time of the operation cycle.

In addition, thanks to the improvements according to the invention it is possible to obtain pressing of tubes by the reverse method while retaining all of the known advantages of this pressing process.

According to the invention, the press comprises a control apparatus for displacement on the pressing axis of various auxiliary members, comprising a support slidably mounted parallel to the slide on an auxiliary cross beam itself mounted slidably on the movable cross beam parallel to the pressing axis, means for axial displacement of the auxiliary cross beam and means for simultaneous displacement of the support with the slide, each auxiliary member being coupled to the slidable support by a rod and slidably mounted axially on the slide.

BRIEF DESCRIPTION OF THE DRAWING

The invention is now going to be described with reference to specific embodiments given by way of example and represented in the attached drawings.

DETAILED DESCRIPTION

Figure 1:
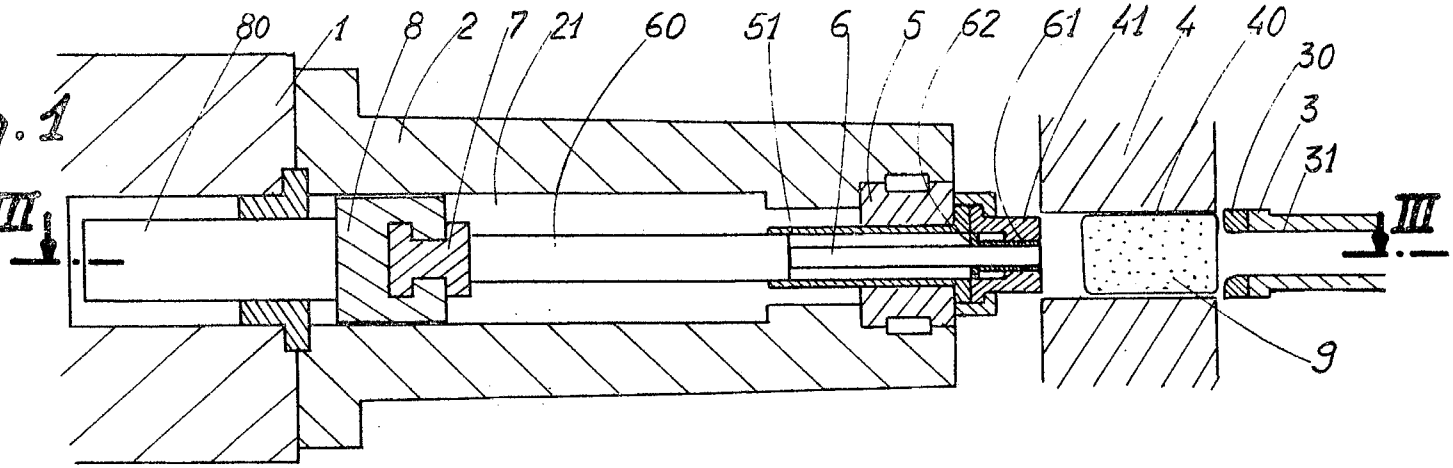
FIG. 1 is an axial sectional view of a portion of a press according to the invention, before pressing.

A press operating by the reverse or indirect method such as that, for example, in French Pat. No. 2,098,808, generally comprises a lintel connected by columns to a fixed cross beam, the assembly forming a frame. The fixed cross beam carries a tubular die casing provided at its extremity with a die which defines a pressing axis. Between the fixed cross beam and the lintel there is a movable cross beam which can be displaced by means of a main jack supported by the lintel. A billet to be pressed is placed in a housing provided in a container placed between the movable cross beam and the die casing. In the attached figures there is only shown the main jack 1 to which the movable cross beam 2 is fixed, the die casing 3 secured to the fixed cross beam and the container or holder 4 placed between the movable cross beam and the die casing. The die casing 3 carries at its extremity a die 30 which is prolonged by a bore 31 traversing the die casing and the fixed cross beam and by which the product formed by the pressing is discharged.

The container 4 is provided along the pressing axis with a housing 40 open at its ends, capable, by axial displacement, of fitting on one side on the die casing, the other side being closed by a base 41 fixed to the movable cross beam.

When a billet is placed in the housing 40, axial displacement of the movable cross beam towards the die casing produces firstly, the closure of the housing 40 by the base 41, then in proportion to the fitting of the container 4 on the die casing the formation in the die of a product discharged through the orifice 31.

As has been indicated by way of example in the French Pat. No. 2,098,808 already cited, it is conventional to mount the base 41 of the container on a support or slide 5 which is displaceable on the movable cross beam 2 transversely with respect to the pressing axis.

This transverse displacement of the base of the container can be obtained either by rotation, in which case the support 5 is in the form of a turret rotatable about an axis parallel to the pressing axis or by translation in which case the support 5 is in the form of a slide which is displaceable by means of a jack perpendicularly to the pressing axis.

In French Pat. No. 2,098,696, there is also disclosed the utilization of the slide for the supply of a new billet, the slide being provided with a housing offset transversely with respect to the base of the container and on which the new billet can be placed. When the slide is displaced transversely to offset the base of the container at the end of the pressing operation, the new billet is transported to the pressing axis and a supply jack, mounted, for example, on the movable cross beam on the pressing axis permits the new billet to be pushed into the container. Such an arrangement greatly accelerates the operations and also permits simplication of the mechanical apparatus of the press, notably by shortening the same. However, the apparatus disclosed in this patent, particularly the utilization of a supply jack placed along the pressing axis, does not permit the easy utilization of other auxiliary members.

Furthermore, by reason of the complexity of the systems utilized, the method of indirect extrusion or reverse pressing has not been utilized up to the present for the pressing of tubes. As will be seen, the apparatus according to the present invention permits the formation of tubes by the indirect or reverse method while retaining all of the advantages of this method, and notably the mode of supply by the slide disclosed in the patent already cited.

As shown in FIG. 1, the support 5 and the base of container 41 are provided with a bore in which extends a plunger 6 mounted at the extremity of a holder 60. The holder 60 is constituted by a cylindrical rod whose extremity carrying the plunger 6 can slide in a tube 51 fixed on the slide 5 and whose length permits guidance of the extremity of the holder 60 over a length slightly greater than that of the billet.

At its rear extremity, opposite the plunger, the rod 60 is fixed to a support 7 slidably mounted parallel to the slide 5 on an auxiliary cross beam 8.

The auxiliary cross beam 8 can itself be displaced parallel to the pressing axis and over a length at least equal to that of the container 4 in a housing 21 provided in the interior of the movable cross beam 2. The displacement of the auxiliary cross beam 8 is effected by a jack 80 mounted along the pressing axis at the interior of the main jack 1.

Further provided are means to effect simultaneous displacement of the slide 5 and the support 7. These means can be simply constituted by connection members which effect the displacement of the support 7 at the same time as that of the slide 5. However, the slide 5 is generally driven by a jack 50 whose body is mounted on the movable cross beam, the displacement of the support 7 preferably being effected by a jack 71 generally of the same size as the jack 50, the two jacks being simultaneously fed in synchronism, the body of the jack 71 being fixed on the auxiliary cross beam 8.

Figures 3, 4:
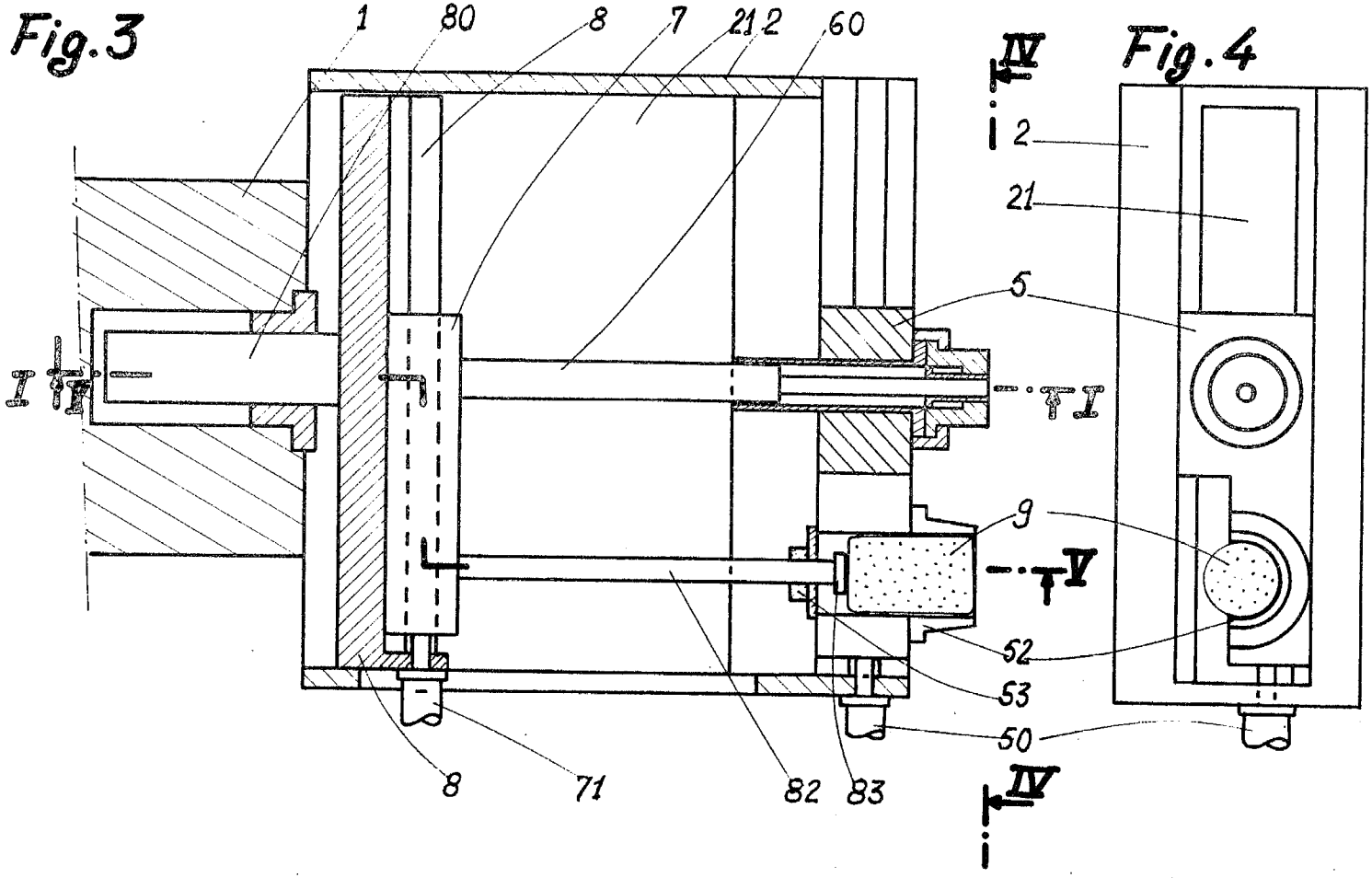
FIG. 3 is a view from above, in section, taken along line III—III in FIG. 1 of the apparatus components carried by the movable cross beam.
FIG. 4 is a front view of the slide, the press being in pressing position.

As shown in FIG. 3, the slide 5 is provided, in a position off-set with respect to the bottom of the container, with a housing 52 in which can be placed a new billet to be pressed. The housing 52 has a generally semi-cylindrical shape of a diameter substantially equal to that of the housing 40 of the container and its axis can be brought into coincidence with the pressing axis by displacement of the slide 5.

Along the axis of the housing 52 there is disposed a push rod 82 of a length at least equal to that of the container 4 and whose front extremity is slidably mounted axially in a support 53 fixed to the slide 5 at the back of the housing 52. The rear extremity of the rod 82 is fixed to the slidable support 7. The rod 82 can optionally be provided at its front end with a plate 83 for applying pressure to the billet.

Figure 2:
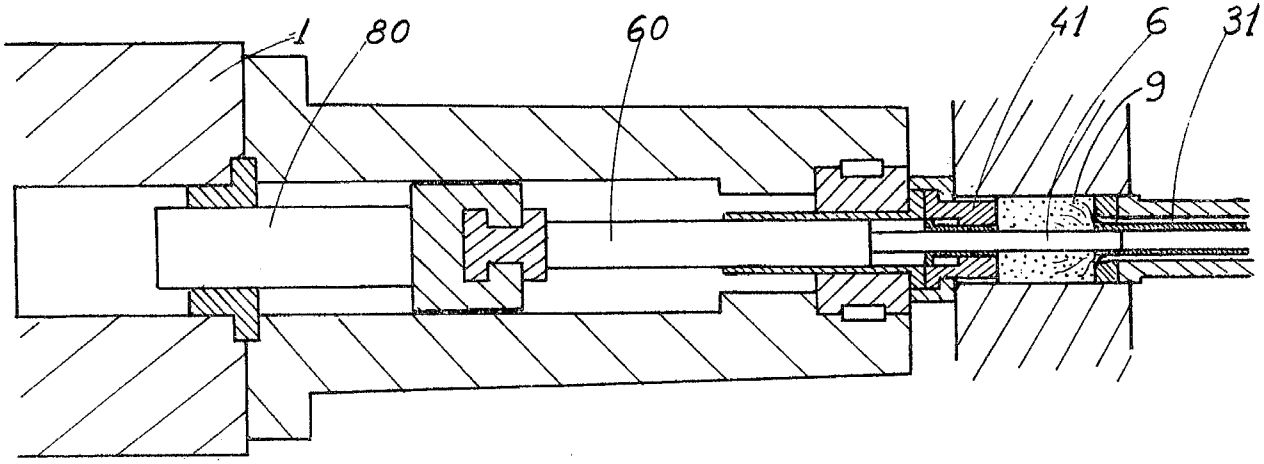
FIG. 2 is an axial sectional view of a portion of the press according to the invention during the pressing of a tube.

The operation of the press is as follows:

After a billet 9 has been placed in the housing 40 of the container 4, the movable cross beam is advanced as shown in FIG. 1 until the base 41 bears against the container 4. By means of the jack 80, the plunger 6 is then advanced through the intermediary of holder 60 and the cross beam 8, the plunger traversing the billet up to the point that its extremity slightly extends into the die 30, as shown in FIG. 2. By then advancing the movable cross beam by means of the main jack 1, pressing of the billet is effected and a tube is formed in the space between the plunger 6 and the die 30 which is fed into the axial conduit 31.

The apparatus according to the invention permits the use of various known methods for pressing tubes. In fact, one can effect, by the techniques of accompanying plunger, advance of the plunger at the same time as the container, the plunger then penetrating into the interior of the die casing. In this case there is practically no force furnished by the jack 80 since the plunger is driven by friction.

However, the plunger can also be prevented from penetrating into the die casing by maintaining its extremity in the die by means of the jack 80 which can hold the plunger during the advance of the movable cross beam.

At the end of the pressing operation, there remains between the base 41 of the container and the die 30, a metal plug attached to the formed tube. In order to separate the plug from the tube, a conventional cutting technique is employed. However, in the apparatus according to the invention, the plunger can be actuated in very simple manner by the jack 80. In fact, the cutting device is constituted by a sleeve 61 secured on the plunger and whose external diameter is substantially equal to that of the die. The sleeve 61 is slidably mounted in the base 41, the latter having a diameter slightly less than that of the housing 40 in order to slightly penetrate therein. Furthermore, the sleeve 61 is provided with an enlarged base 62 whose exterior diameter is equal to that of the holder 60 which is slidable in the interior of the tube 51. The holder 60 thus has a shoulder 63 which, when the plunger is in the position for pressing, comes into proximity with the base 62 of the cutting device 61. As has been indicated previously, in the technique of accompanying plunger, the plunger advances at the same time as the container, the jack 80 preventing the plunger from being advanced by the friction more rapidly than the container. If the plunger is held in fixed relation with respect to the die casing, at the end of the pressing operation the plunger will be retracted with respect to the base of the container to occupy a position little different from that shown in FIG. 1. In both cases, however, it is possible by means of the jack 80 to displace the cross beam 8 such that the shoulder of the holder 60 bears against the base 62 of the cutting device 61 and forces the latter to traverse the plug and extend into the die 30, thereby achieving separation of the plug from the formed tube.

The plunger is then retracted to the position in FIG. 1 and the base 41 is offset from the pressing axis by means of the slide 5 in order to proceed with the discharge of the plug.

In the manner which has been disclosed in French Pat. No. 2,098,696 a new billet 9' is placed in the housing 52 at the end of the pressing operation. When the slide 5 is displaced to offset the base of the container, the housing 52 is transported at the same time to the pressing axis. The guidance of the front extremity of the holder 60 in the tubular cutting device 61 and of the front extremity of the rod 82 in the member 53 can be sufficient for the slide 5 to also control the displacement of the slidable support 7 in the auxiliary cross beam 8. However, it is preferable to control the displacement of the slidable support 7 by means of jack 71 which is fed simultaneously with the jack 50 which controls the displacement of the slide 5 so that the two displacements are precisely indentical.

Figure 5:
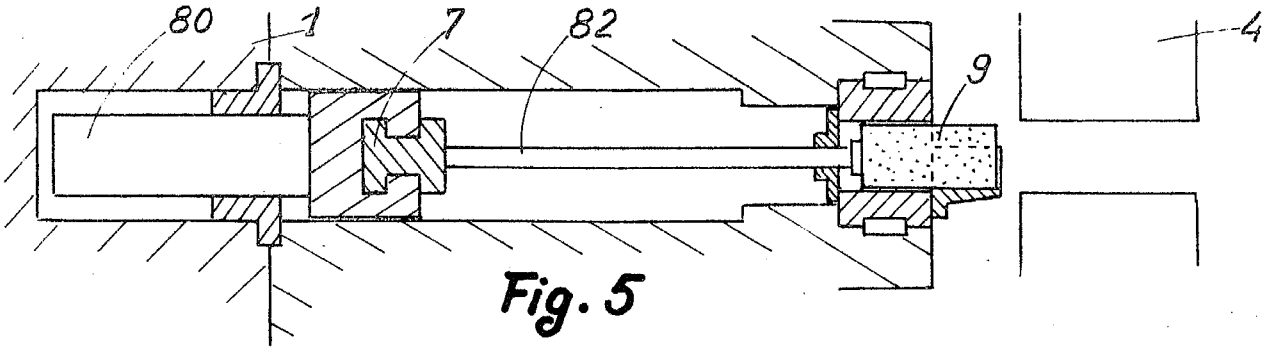
FIG. 5 is a sectional view taken along line V—V in FIG. 3 with the press in a supply position.
Figure 6:
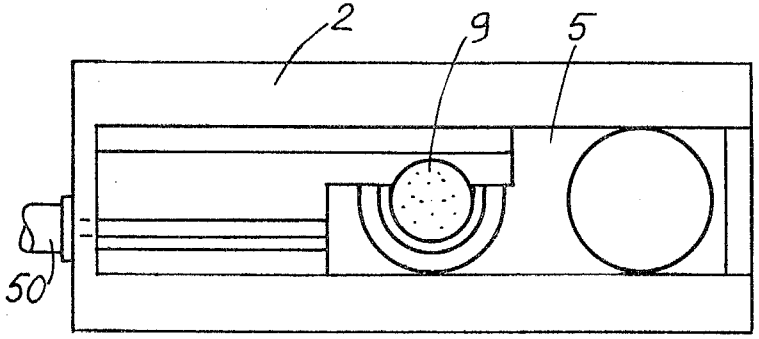
FIG. 6 is a front view of the slide in the supply position.

The housing 52 is then disposed along the pressing axis in the position shown in FIGS. 5 and 6. After having proceeded with the discharge of the plug and the flashing sleeve, and after resetting the container in position, the rod 82, actuated by the jack 80, pushes the new billet into the container 4, this having been spaced from the die casing and approaching the movable cross beam. After this placement of the billet, the cross beam 8 is retracted to the position in FIGS. 1 and 5 and the slide 5 can return the base 41 to the position on the pressing axis for a new pressing operation.

Figure 7:
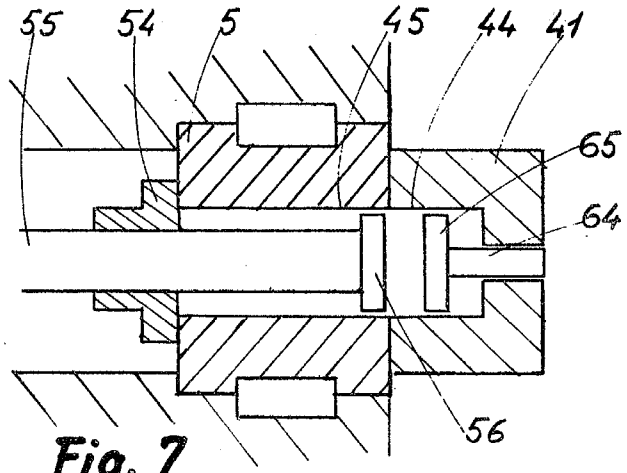
FIG. 7 is a view of a portion of a press showing the base of a container provided with a cutting device in the case of production of a wire.

The preceeding embodiment discloses the formation of tubes. However, the invention is also applicable to the operation of forming bars by a pressing operation. In this case, as is shown in FIG. 7, there is placed along the axis of the base 41 a cutting device 64 comprising a rod of a diameter slightly less than that of the bar to be formed, and at its rear an enlarged base 65 slidably mounted in the interior of a bore 44 provided in the base 41 of the container and in prolongation with a bore 45 of the same diameter in the slide 5. A sleeve 54 fixed on the rear face of the slide 5 effects guidance of a rod 55 whose rear extremity is fixed to the slidable support 7 and whose front extremity is provided with a head 56 which is displaced in the interior of the bore 45 so as to be applied against the base 65 of the cutting device 64.

During the pressing operation, the rod 55 and the cutting device 64 remain retracted. At the end of the pressing operation, the jack 80 acts, through the intermediary of the rod 55, to press against the cutting device 64 which separates the pressed bar from the plug.

In the same fashion as described previously, the base 41 provided with the cutting device is associated with a housing 52 for supply of a new billet.

In both preceeding cases, the slide 5 can therefore occupy two positions, one for the pressing operation and the other for supply, and the positions according to the invention permit placement along the pressing axis of various auxiliary members such as a plunger for the pressing operation, a cutting device or a supply housing for a new billet and a rod for pressing the billet into the housing of the container. However, the same arrangements could be utilized for a slide having three positions, for example, if it is desirable to separate the cutting member from the base of the container.

One could also utilize the invention to place other accessory members along the pressing apparatus, for example, a means for shearing and discharging the plug.

The invention is not limited to the details of the embodiments which have been disclosed, but in contrast it encompasses all variations and particularly those which are only differentiated by the use of equivalent means.

What is claimed is:

1. A press for extruding tubes by the indirect method comprising:

a fixed tubular die casing having a die and defining a pressing axis, a main cross beam supported for movement parallel to the pressing axis, a main jack coupled to the cross beam for displacement thereof, a container for a billet to be extruded supported for movement parallel to the pressing axis, said container having open extremities one of which is capable of fitting on the die casing upon movement of the container parallel to the pressing axis, a base for closing the other extremity of the container, a slide carrying said base and displaceable on the cross beam transversely with respect to the pressing axis, a housing mounted on said slide in a laterally offset position for loading a billet to be extruded, means for displacing the slide to selectively position said base or said housing on said pressing axis, an axially displaceable push rod for displacing said billet from said housing, an auxiliary jack mounted within the main jack and acting along the pressing axis, an auxiliary cross beam slidably mounted on said main cross beam for movement parallel to the pressing axis; said auxiliary cross beam being coupled to and actuated by said auxiliary jack, a support extending parallel to said slide and mounted for slidable transverse movement in said auxiliary cross beam, means for controllably displacing said support transversely and simultaneously with the slide, and a holder extending parallel to the pressing axis having a rear extremity secured to said support for movement therewith and a plunger secured to said holder and slidably mounted in said base, said push rod for displacing the billet from said housing having a rear extremity also secured to said support for movement therewith and a front extremity slidably mounted on said slide axially within said housing.

2. A press as claimed in claim 1 further comprising cutting means for severing a plug from the extruded tube, said cutting means surrounding said plunger and being slidably mounted in said base for traversing said base, said holder being positioned to contact the cutting means to operate the same to slidably advance on said plunger.

3. A press as claimed in claim 1 further comprising a further base for the extruding of bars, said further base being mounted on said slide and provided with a cutter traversing said further base along the axis thereof, and an actuating rod for said cutter having a front extremity slidably mounted axially on said slide and a rear extremity secured to said support.

* * * * *